US006785916B2

(12) United States Patent
Tanaka

(10) Patent No.: US 6,785,916 B2
(45) Date of Patent: Sep. 7, 2004

(54) CARE BEDPAN AND A CARE BEDPAN SYSTEM

(75) Inventor: Yoshitaka Tanaka, Nagasaki (JP)

(73) Assignee: Birumen Kagoshima Co., Ltd., Kagoshima (JP)

( * ) Notice: Subject to any disclaimer, the term of this patent is extended or adjusted under 35 U.S.C. 154(b) by 0 days.

(21) Appl. No.: 10/301,786

(22) Filed: Nov. 22, 2002

(65) Prior Publication Data

US 2003/0093856 A1 May 22, 2003

(30) Foreign Application Priority Data

Nov. 22, 2001 (JP) ..... 2001-357615

(51) Int. Cl.[7] ..... A61G 9/00
(52) U.S. Cl. ..... 4/455; 4/457; 4/450; 604/355
(58) Field of Search ..... 4/450, 455, 457, 4/446; 604/355, 335, 334, 327

(56) References Cited

U.S. PATENT DOCUMENTS

| | | | | | |
|---|---|---|---|---|---|
| 996,200 | A | * | 6/1911 | Betsworth | 4/450 |
| 1,918,083 | A | * | 7/1933 | Case | 4/450 |
| 4,791,686 | A | * | 12/1988 | Taniguchi et al. | 4/448 |
| 5,342,583 | A | * | 8/1994 | Son | 422/107 |
| 5,363,514 | A | * | 11/1994 | Lee | 4/455 |
| 5,681,297 | A | * | 10/1997 | Hashimoto et al. | 604/355 |
| 6,394,988 | B1 | * | 5/2002 | Hashimoto | 604/355 |
| 6,443,939 | B1 | * | 9/2002 | Oki et al. | 604/393 |
| 6,554,817 | B1 | * | 4/2003 | Oki et al. | 604/393 |

FOREIGN PATENT DOCUMENTS

| | | |
|---|---|---|
| DE | 43 33 530 A | 4/1995 |
| DE | 296 12 166 U | 9/1996 |
| JP | 4-50019 | 4/1992 |
| JP | 7-15537 | 4/1995 |
| JP | 8-322868 | 12/1996 |

* cited by examiner

*Primary Examiner*—Gregory L. Huson
*Assistant Examiner*—Huyen Le
(74) *Attorney, Agent, or Firm*—Sughrue Mion, PLLC

(57) ABSTRACT

A care bedpan and a care bedpan system that are capable of reducing the burden of wasting excrements within the care bedpan, of enabling easy use of the bedpan, and of reducing the burden on both, the care-receiving person as well as the care-giving person are provided. A movable and portable care bedpan provided with a bedpan main body 10 having an opening 31 that is pressed against or disposed to oppose a pubic region of a care-receiving person for receiving excrements, and with a cover 33 provided to extend frontward from an upper portion of the opening 31 of the bedpan main body 10 to thereby comprise an entire opening of the bedpan together with the opening 31 of the bedpan main body 10. In the cover 33 is held by a holding mechanism which angle is adjustable, either in a multi-staged or non-staged manner, so as to adjust the size of the entire opening and to shield one's pubic region to be hardly visible from above. Upon connecting an accessory unit to the bedpan 10, it is possible to arrange a care bedpan system for supplying washing water, cleaning water (warm water) and warm air for drying and for sucking excrements (including waste water etc.) and collecting the same in a waste water tank.

5 Claims, 6 Drawing Sheets

CARE BEDPAN AND A CARE BEDPAN SYSTEM

RELATED APPLICATION

This application claims the priority of Japanese Patent Application No. 2001-357615 filed on Nov. 22, 2001, which is incorporated herein by reference.

BACKGROUND OF THE INVENTION

1. Field of the Invention

The present invention relates to a care bedpan and a care bedpan unit including the same.

2. Description of the Related Art

It is conventionally performed that a care bedpan is located next to a bed and in the case a care-receiving person is to use the bedpan, the bedpan is moved onto the bed for receiving and accumulating excrements by the bedpan on the bed whereupon the bedpan is carried to a restroom or similar for wasting the excrements.

However, it takes the trouble to carry the bedpan to the restroom and to waste the excrements, and the problem of odor hanging in the air exists. Moreover, excrements of the care-receiving person may scatter to outside of the bedpan or the care-receiver may feel some sense of shame in exposing his or her pubic region to face the bedpan when using the bedpan and thus lead to some discomfort in performing excretion.

SUMMARY OF THE INVENTION

It is an object of the present invention to provide a care bedpan that is capable of reducing the burden of wasting excrements within the care bedpan, of enabling easy use of the bedpan, and of reducing the burden on both, the care-receiving person as well as the care-giving person.

The present invention relates to a movable and portable bedpan provided with a bedpan main body having an opening that is pressed against or disposed to oppose a pubic region of a care-receiving person for receiving excrements, and with a cover provided to extend frontward from an upper portion of the opening of the bedpan main body to thereby form an entire opening of the bedpan together with the opening of the bedpan main body, wherein the cover is held by a holding mechanism which angle is adjustable, either in a multi-staged or non-staged manner, so as to adjust the size of the entire opening and to shield one's pubic region to be hardly visible from above.

By providing such a cover on the opening of the bedpan, excrements (and especially urine) can be prevented from scattering, and since the pubic region of the care-receiving person will be hardly visible, the sense of shame of the care-receiving person may be reduced at the time of using the bedpan so as to ease mental burdens occurring at the time of using the bedpan.

The present invention further relates to a movable and portable bedpan provided with a bedpan main body having an opening that is pressed against or disposed to oppose a pubic region of a care-receiving person for receiving excrements, an inner side of said opening being provided with a front-sided bottom portion that extends in a substantially horizontal manner rearward from a front end and that is surrounded by a low bottom wall portion, and a rear-sided rising portion that rises substantially upward from rear-side of said front-sided bottom portion and at least both sides of which are surrounded by a low side wall portion, wherein a rearward facing washing water outlet for discharging washing water for processing excrements in a rearward direction is formed at a bottom wall portion at a tip end of said front-sided bottom portion whereas a suction inlet for sucking said excrements and washing water is formed at a lower end portion of a front-sided rising wall portion rearward of said washing water outlet, and wherein a cleaning water outlet for jetting cleaning water for cleaning one's pubic region in a frontward direction is formed further upward of said suction inlet of said rear-sided rising wall portion and the cleaning water is sucked by said suction inlet. Here, an excrement sensor may be provided on the bottom surface of the front-sided bottom portion for detecting excrements.

With this arrangement, the care-receiving person may use the bedpan on the bed or similar upon approaching his or her pubic region to the opening of the bedpan mounted on the bed and may flush the excrements with the washing water. The washing water will be discharged from the front end portion of the front-sided bottom portion in the rearward direction and with a suction inlet being provided in this rear direction, the excrements will be effectively guided to the suction inlet. Through the cleaning water (warm water etc.) that is discharged from the cleaning water outlets provided at the rear-sided rising portion of the front-sided wall portion, one's pubic region after excretion may be cleaned, and in the case an air outlet for drying (warm air blowing outlet etc.) is additionally provided at the rising wall portion, one's pubic region may be further dried after cleaning. It is accordingly possible to achieve a care bedpan that causes quite a small burden on both, the care-receiving person and the care-giving person.

In the present invention, there may be arranged a care bedpan system comprising the above care bedpan and an excrement collecting device for sucking and collecting excrements together with washing water from the bedpan. The excrement collecting device may include a suction hose for sucking excrements that is connected to the bedpan, a suction device that is connected to the hose for setting the interior of the hose to negative pressure so as to suck and transfer the excrements through the hose, an excrement tank for collecting excrements that are transferred through the hose, and an excrement tank holder for fixing the excrement tank in a freely attachable/detachable manner. It is further possible to provide a washing water supplying device for supplying washing water for washing excrements for the washing water outlet on the bedpan wherein the waste water after washing is collected by the excrement collecting device together with the excrements.

In another preferred embodiment, a cleaning device for supplying a cleaning medium such as warm water for cleaning one's pubic region after excretion (hereinafter referred to as "warm water") from a warm water tank to the discharge outlet within the bedpan and for jetting the same through the discharge outlet is provided, wherein waste water after cleaning is received by the bedpan and collected through the excrement collecting device. A drying device for making warm air for drying one's pubic region after cleaning through the cleaning device blown out through an air-blowing outlet of the bedpan is also provided.

A circulating conduit may be formed for accumulating, at the time of collecting the sucked excrements into the collecting device together with air, the excrements in the excrement tank while only air is sucked to a sucking driving unit through a suction conduit and wherein pressurized air that has passed through the suction driving unit and that has become positive pressure on the downstream side is circulated to the bedpan side as air (pressure air) for sending out washing water and/or cleaning water to the bedpan. The pressurized air may also be circulated to the bedpan side to be utilized as air for drying one's pubic region after cleaning.

According to such an arrangement, upon utilizing the fact that air for sucking and collecting excrements and others is not only used for its sucking actions, but also its properties that it becomes pressurized air downstream of the suction driving unit, air may be circulated to the bedpan side as pressure air for sending out washing water or warm water for cleaning and the suction driving unit may thus be concurrently used as a means for sending out washing water or warm water for cleaning. In this manner, the structure may be simplified and become compact when compared with a case in which an exclusive means for sending out is provided and at least a part of exhaust of suction air may be reduced so that its exhaust sound will be quiet and its odor reduced.

The circulating conduit is preferably provided with the discharge outlet for discharging a part of the circulating air sent through the suction driving unit, to the exterior and an adjusting valve for adjusting the amount of discharge of air through the discharge outlet. By releasing a part of air in such a manner, suction force from the bedpan may be improved and the suction force may be further adjusted.

It should be noted that it is alternatively possible to provide an opening/closing valve in parallel to (or upstream of the discharge outlet and the adjusting valve) so as to generate maximum suction force at the time of sucking excrements, and it is also possible to close the opening/closing valve after temporary releasing all of air in the opened condition thereof to move a specified amount of air to be discharged from the adjusting valve. The adjusting valve and the opening/closing valve may also be replaced by a single valve device (for instance, a complex solenoid valve etc.) instead of providing them separately. It is further possible to employ an arrangement in which only the opening/closing valve is provided while the discharge outlet (adjusting valve) is omitted, and the opening/closing valve is opened when required.

DESCRIPTION OF THE PREFERRED EMBODIMENTS

Figure 1:
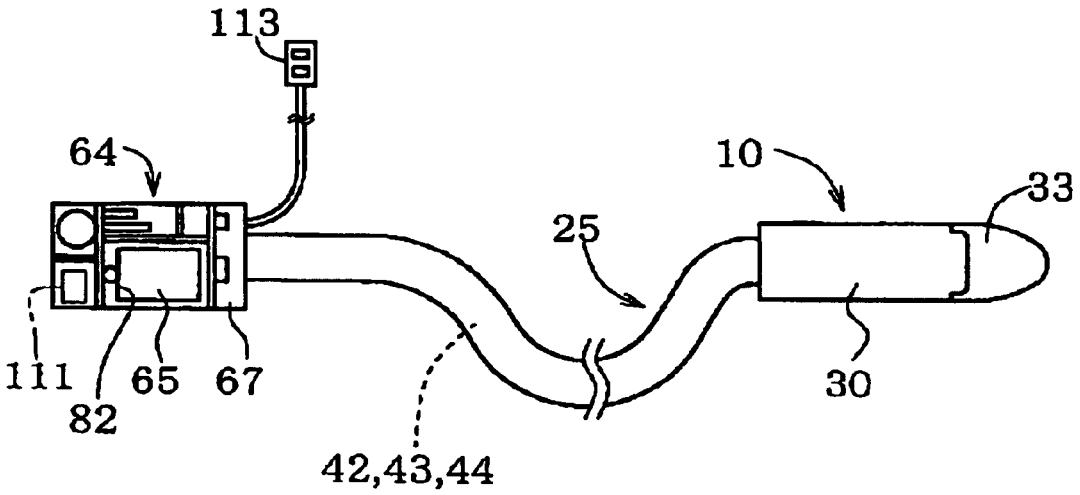
FIG. 1 is a simplified plan view of a care bedpan and a care bedpan system representing one embodiment of the present invention.

Forms for embodying the present invention will now be explained with reference to embodiments as illustrated in the drawings.

Figure 2:
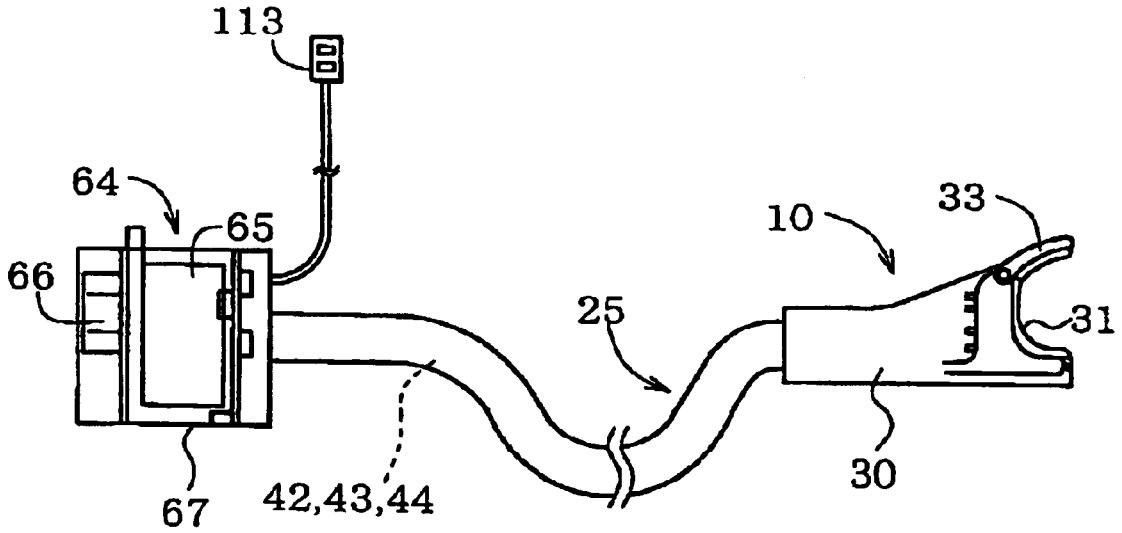
FIG. 2 is a simplified side view thereof.
Figure 3:
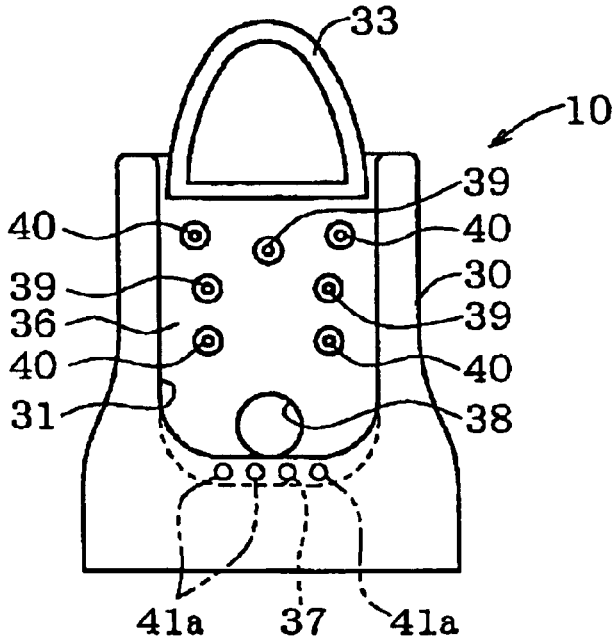
FIG. 3 is a front view of the above care bedpan.
Figure 4:
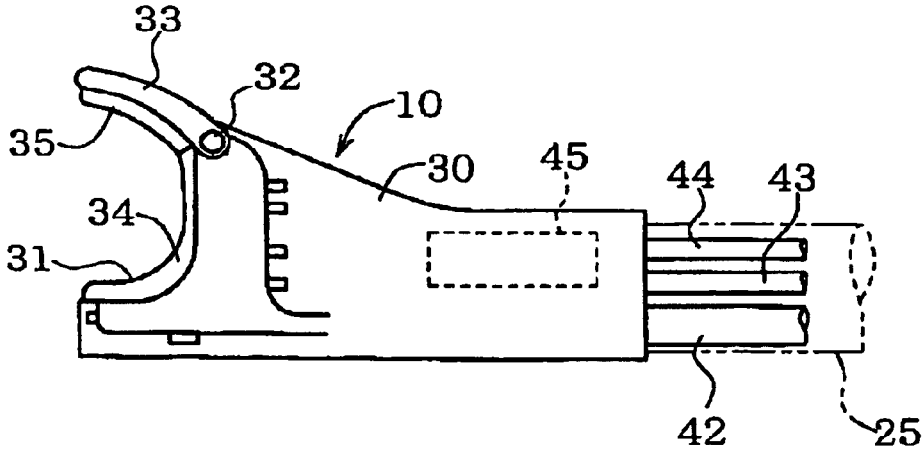
FIG. 4 is a side view of FIG. 3.
Figure 5:
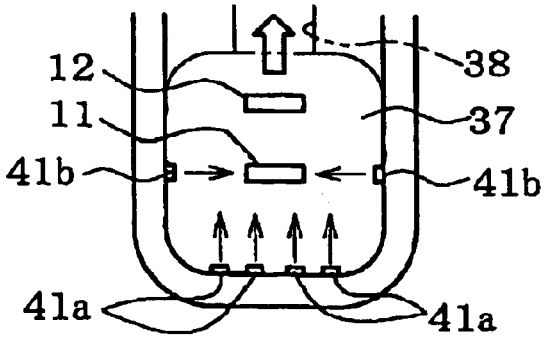
FIG. 5 is a plan view of a front-sided portion of FIG. 4.

As illustrated in FIGS. 1 to 5, a bedpan 10 is formed with a base thereof being a bedpan main body 30 of laterally elongated type and includes an opening portion (opening) 31 at a front end thereof. As shown in FIGS. 3 to 5 with the enlarged manner, the opening 31 is formed in an upwardly rising form after once retracting backwards by a specified extend along a bottom portion of the bedpan main body 30 and with a lid member 33 that may rotate in vertical directions being attached around a fulcrum 32 at an upper end portion thereof.

Artificial skins (e.g. foamless urethane rubber as a gel-like member exhibiting elasticity) 34, 35 are fixedly attached (these exhibit self-adhesiveness and may be fixedly attached to be freely attachable/detachable) so as to border outer edge portions of the opening 31 to the lid member 33 while bridging from downward surfaces of the opening 31 to the lid member 33, wherein these artificial skins 34 and 35 substantially form the entire opening of the bedpan 30 such that this portion is fitted against the pubic region of the care-receiving person (or is pressed against the pubic region for substantially close contact).

The lid member 33 is arranged in that its angle is adjustable in a multi-staged manner (or alternatively in a non-staged manner) through a section mechanism provided proximate of the fulcrum 32, and its angle may be adjusted to suit the body shape or the sex and other factors of a care-receiving person. As will be explained later, the lid member 33 is for preventing scattering of excrements or warm water and others to the periphery at the time of excretion, washing treatments after excretion or jetting warm water for cleaning one's pubic region, and further functions to cover the pubic region of a care-receiving person so as to reduce one's sense of shame at the time of excretion.

A depth portion of the opening 31 of the bedpan 10 is formed as a rear-sided rising wall 36 (FIG. 3) and a downward portion of the rising wall 36 comprises a bottom portion (front-sided bottom portion) 37 of the opening. A suction inlet 38 for sucking excrements after excretion, treating water for washing and warm water after cleaning treatments is formed at a lower end portion of the rear-sided rising wall 36.

The rising wall 36 is further formed with a plurality of, for instance, three warm water jetting outlets (cleaning water outlets or warm water outlets) 39 and a plurality of (e.g. four) warm air blowing outlets (air outlets or warm air outlets) 40 for drying one's pubic region that has been cleaned by the warm water. The warm water jetting outlets 39 concurrently serve as outlets for jetting water for washing treatment (washing water). The warm water jetting outlet 39 in the center of the upper portion jets warm water out in a spraying manner and is effective to serve, for instance, as a bidet. It is preferable that the remaining (right and left) warm water jetting outlets 39 are comprised with a rotating nozzle of e.g. spherical shape such that its jetting direction may be adjusted within a specified angular range such that linear jetting directions may be selected in accordance with the body shape or the sex of a care-receiving person.

The bottom surface (front-side bottom portion) 37 of the opening is similarly formed with a plurality of (e.g. four) warm water jetting outlets (for washing) 41*a* located frontward of the suction inlet 38 and a plurality of (e.g. two) warm water jetting outlets 41*b* located sideward on both sides. The jetting outlets 41*a* and 41*b* formed on the bottom surface 37 of the opening are for washing treatments of excrements wherein water (warm water) is jetted rearward from the discharge outlets 41*a* formed on the low rising wall located frontward of the bottom surface 37 while water (warm water) is jetted to a central side of the bottom surface through the discharge outlets 41*b* on both sides so as to enable easy introduction of excrements and washing water to the suction inlet 38. It should be noted that a sensor 11 (for stools) and a sensor 12 (for urines) for sensing excrements are provided on the bottom surface 37 of the opening of the bedpan 10 that are connected to a control unit of an accessory unit 64 (see FIG. 1) to be described later.

A warm water hose (cleaning hose) 43 that is to be described later is connected to the warm water (and concurrently washing treatment water) jetting outlets 39, 41*a* and 41*b*, air hose 44 is connected to warm air supplying outlet (blowing outlet) 40, and a suction hose 42 is connected to the suction inlet 38 from rearward of the bedpan main body 30 upon respectively passing through the interior thereof. All of these hoses 42, 43 and 44 exhibit flexibility (while they may further be covered from outside by, for instance, a bellow-like hose cover 25) and exhibit warping properties that allow movements of the bedpan 10. It should be noted that air supplied through the air hose 44 is heated by a heater 45 provided inside of the bedpan main body 30 such that the heated warm air will be blown out through the warm water blowing outlet 40.

The above-described suction hose 42, the warm water hose 43 and the air hose 44 extending form the bedpan 10 are connected to an accessory unit 64 (reference should be made to FIGS. 1 and 2) provided to be movable proximate to the bedpan 10. The accessory unit 64 serves as an excrement collecting device for sucking and collecting excrements from the bedpan 10 while concurrently serving as a supply source (supplying device) for supplying warm water or warm air to the bedpan 10. The structure related to collection of excrements will first be explained.

The accessory unit 64 is provided with an excrement tank (hereinafter referred to as "waste Water tank") 65 (wherein FIG. 2 illustrates a perspective view of the interior thereof). A fan and motor (hereinafter referred to as "fan motor 66") serving as a suction driving unit is provided downstream of the waste water tank 65, wherein driving of the fan motor 66 affects suction of excrements, washing treatment water (warm water etc.) and warm water after cleaning one's pubic region (hereinafter all together referred to as "waste water") from the bedpan 10 through the suction hose 42 and accumulating the same in the waste water tank 65. The waste water tank 65 assumes a shape of a closed container and is accumulated within a tank accumulating space formed in a housing 67 of the accessory unit 64 upon dropping the same therein from above.

Figure 6:
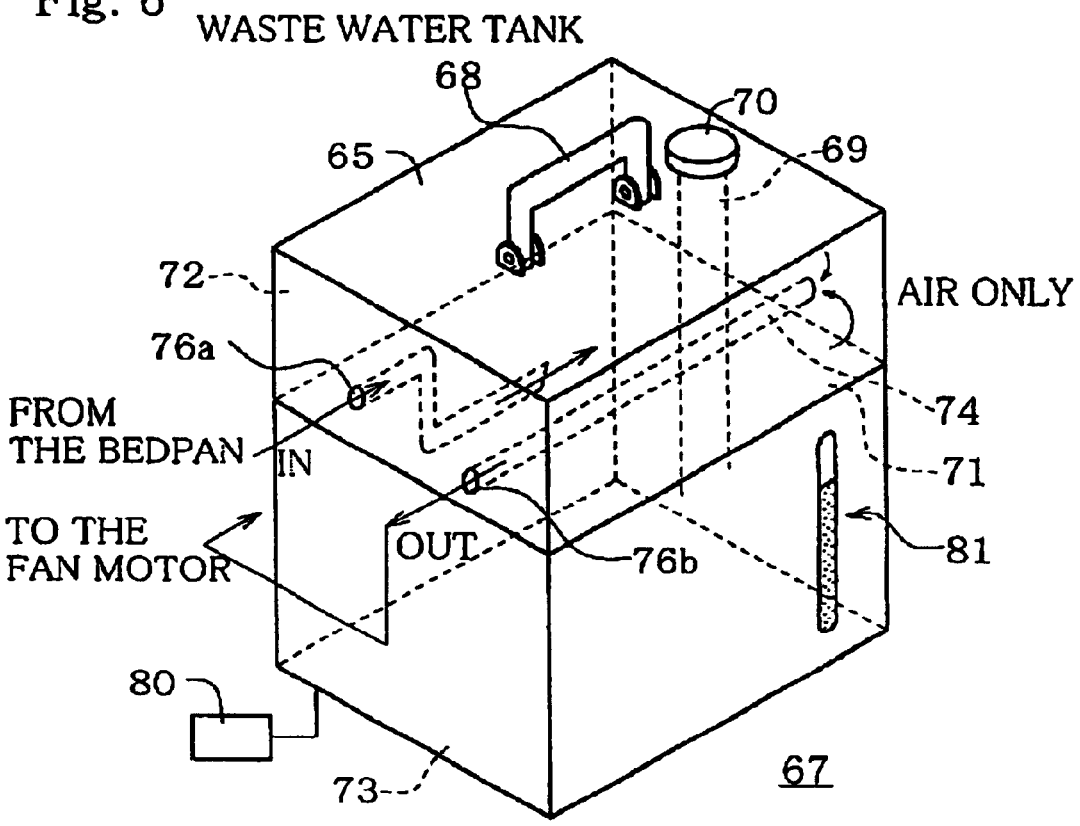
FIG. 6 is a conceptual perspective view of an excrement tank (waste water tank) disposed in an accessory unit of the care bedpan system.
Figure 7A:
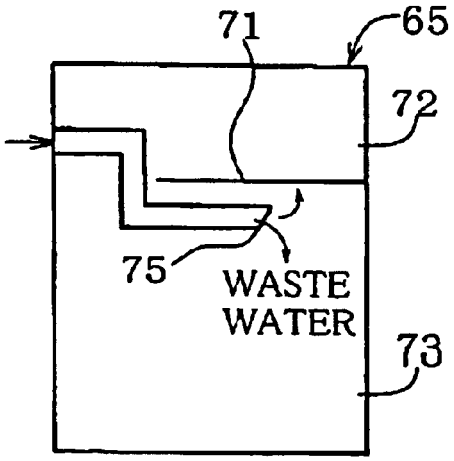
FIGS. 7A and 7B are views for explaining actions of a suction system of the waste water tank.
Figure 7B:
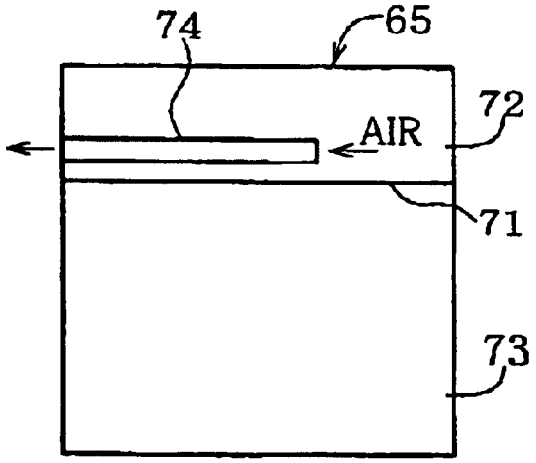

As illustrated in FIG. 6, a grip 68 is provided on an upper portion of the waste water tank 65 with a discharge portion 69 for the waste water being formed on an upper portion thereof which opening is closed by a cap 70. The waste water tank 65 assumes a shape of a box-shaped closed container which interior is divided through a partition 71 into an upper air sucking space 72 and a waste water accumulating space 73 downward thereof as illustrated in FIGS. 7A and 7B. Upon suction of air from the air sucking space 72 through an air conduit 74, which is affected by the fan motor 66, the interior of the tank 65 comes to negative pressure such that the above-described waste water is sucked. A discharge outlet 75 for the waste water is located downward of the partition 71 wherein scattering of waste water from the waste water accumulating space 73 can be prevented owing to the discharge of waste water through the discharge outlet 75 and only air is sucked through the air conduit 74 by the fan motor 66.

A suction inlet (intake) 76*a* for sucking waste water (excrements, washing treatment water, and cleaning water etc.) from the bedpan 10 and a suction inlet 76*b* for further sucking air from the waste water tank 65 are formed on a part of an outer shell such as a wall surface of the waste water tank 65, wherein a waste water introducing conduit and an air suction conduit (not shown) formed in the accessory unit 64 are respectively connected for communication with the waste water tank 65 being mounted to and accumulated in the housing (case) 67.

The above-described discharge portion 69 is communicated to only the waste water accumulating portion 73 such that waste water accumulated therein may be discharged to a specified place from the discharge portion 69 upon taking the waste water tank 65 out from the housing 67 and inclining the same. It is possible to provide an alarming device 80 for informing that the waste water accumulated within the waste water tank 65 has reached a specified amount through a buzzer or a lamp or an indicator 81 enabling visual recognition from the exterior of the housing 67 that to what extent the waste water has been accumulated.

Figure 8:
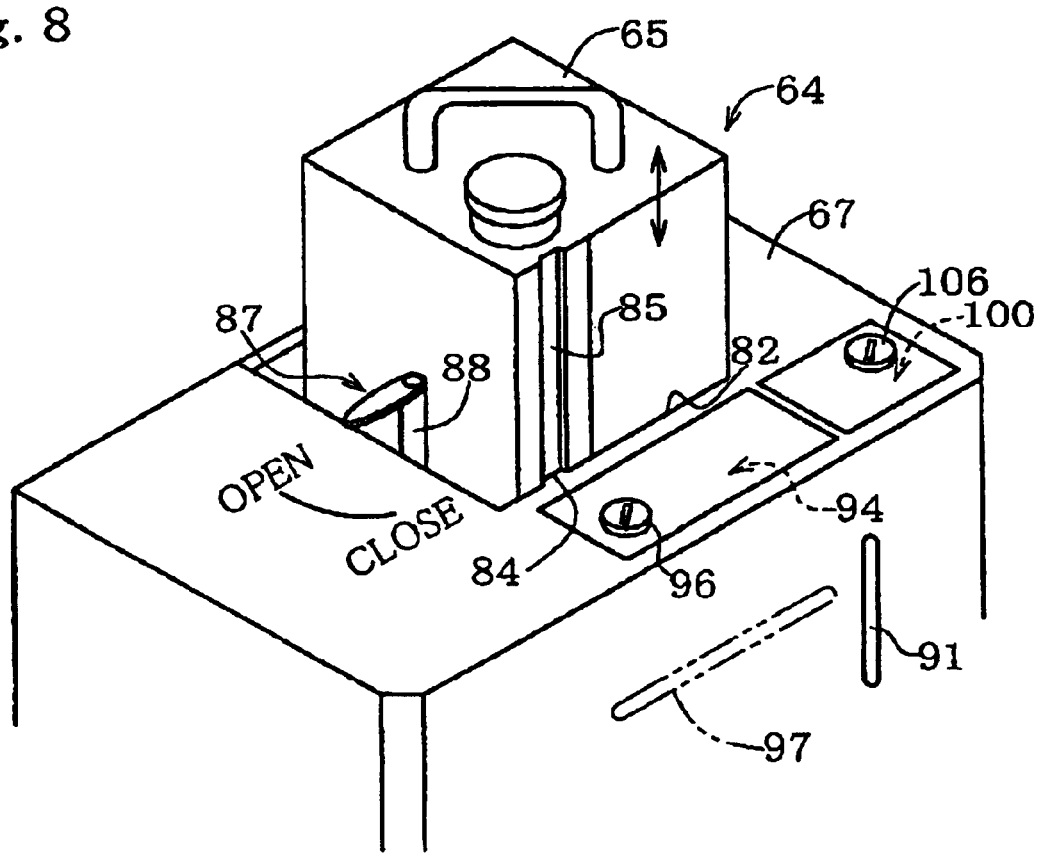
FIG. 8 is a perspective view illustrating a condition in which the waste water tank has been pulled out to an intermediate position from the accessory unit.

As illustrated in FIG. 8, a convex portion 84 or a groove for guiding dropping of the tank 65 is formed in a tank accumulating space 82 formed in the housing 67 while a corresponding guide groove 85 or a convex portion is formed on the outer surface of the tank 65 such that the waste water tank 65 may be dropped with being guided and positioned in the tank housing space 82 through engagement of the concave/convex formed between the housing 67 and the waste water tank 65.

Figure 9A:
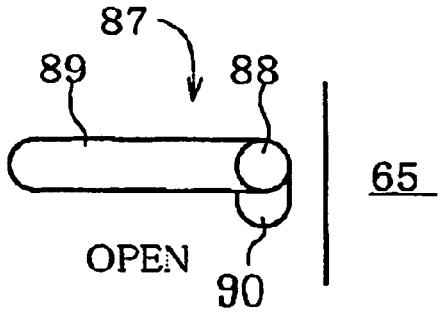
FIGS. 9A and 9B are views for explaining actions for fixing the waste water tank.
Figure 9B:
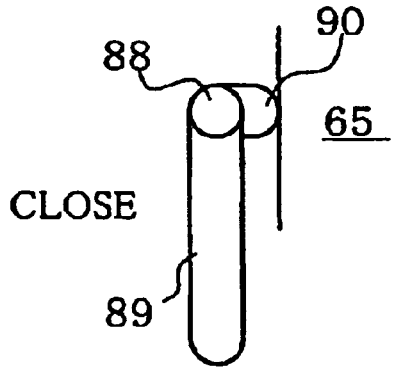

A stopper device 87 which defines a waste water tank holder with the tank accumulating space 82 is further provided as a fixing means for fixing the housed waste water tank 65 within the tank housing space 82. As illustrated in FIGS. 9A and 9B, the stopper device 87 is arranged in that a lock lever 89 is mounted to a shaft 88 while a cam 90 serving as a stopper is further fixed to the shaft 88, wherein the cam 90 separates from the outer surface of the waste water tank 65 when the lock lever 89 is in an open position whereas upon substantially 90° rotation of the lock lever 89 to the closed position, the stopper cam 90 is pressed against the outer surface of the waste water tank 65. In this manner, the waste water tank 65 is pinched between the opposite sided wall surface of the tank housing space 82 and the cam 90 to be fixed thereat whereupon oscillation at the time of suction actions may be prevented or restricted whereas the above-described intake 76*a* for the waste water of the tank and the air suction inlet 76*b* on the wall surface of the waste water tank 65 are pressed against respective conduits (that are open to the wall surface of the tank accumulating space 82) to be connected to and are sealed thereat.

Figure 10:
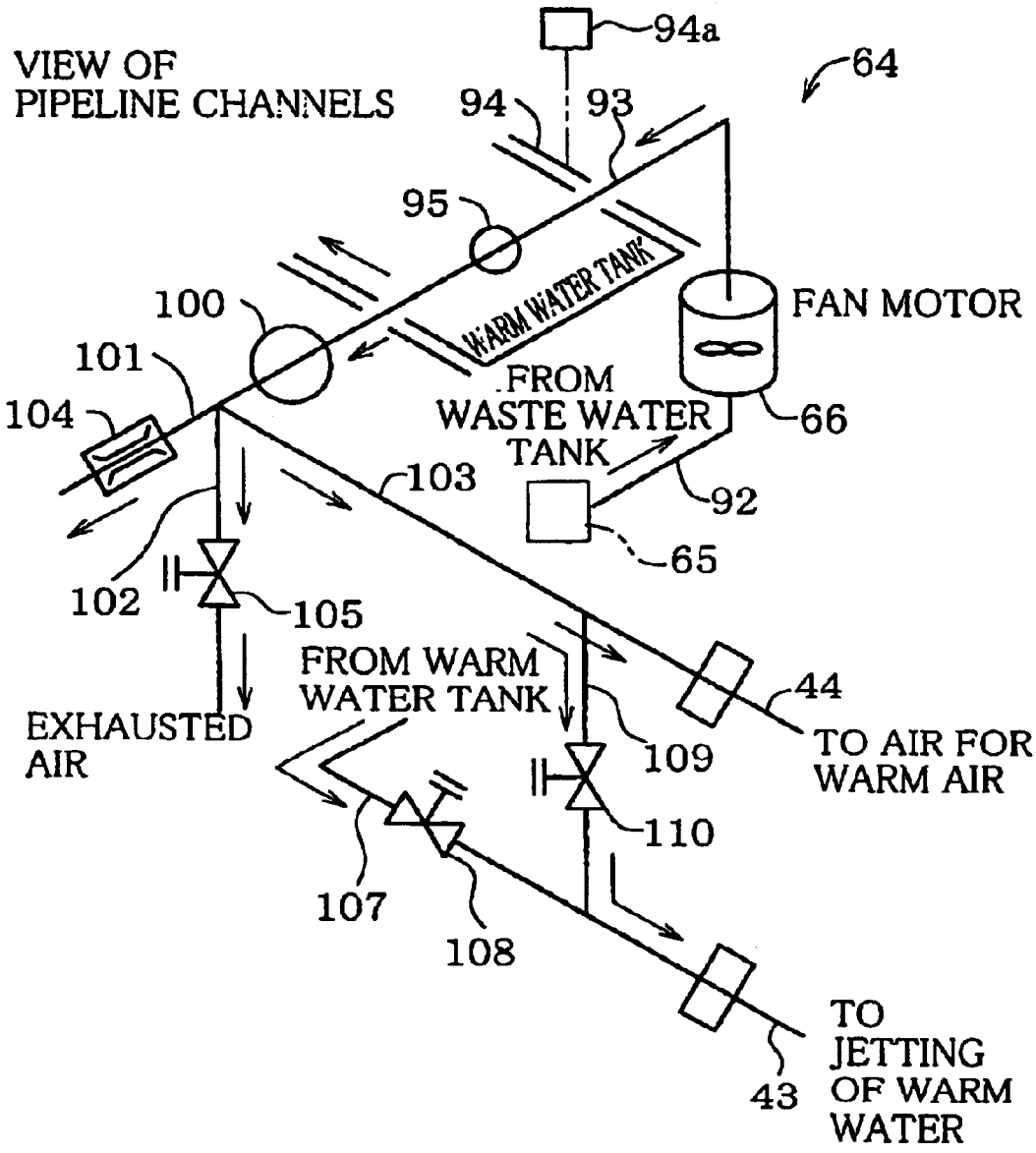
FIG. 10 is a view of a piping system for illustrating a piping system of the accessory unit.
Figure 11:
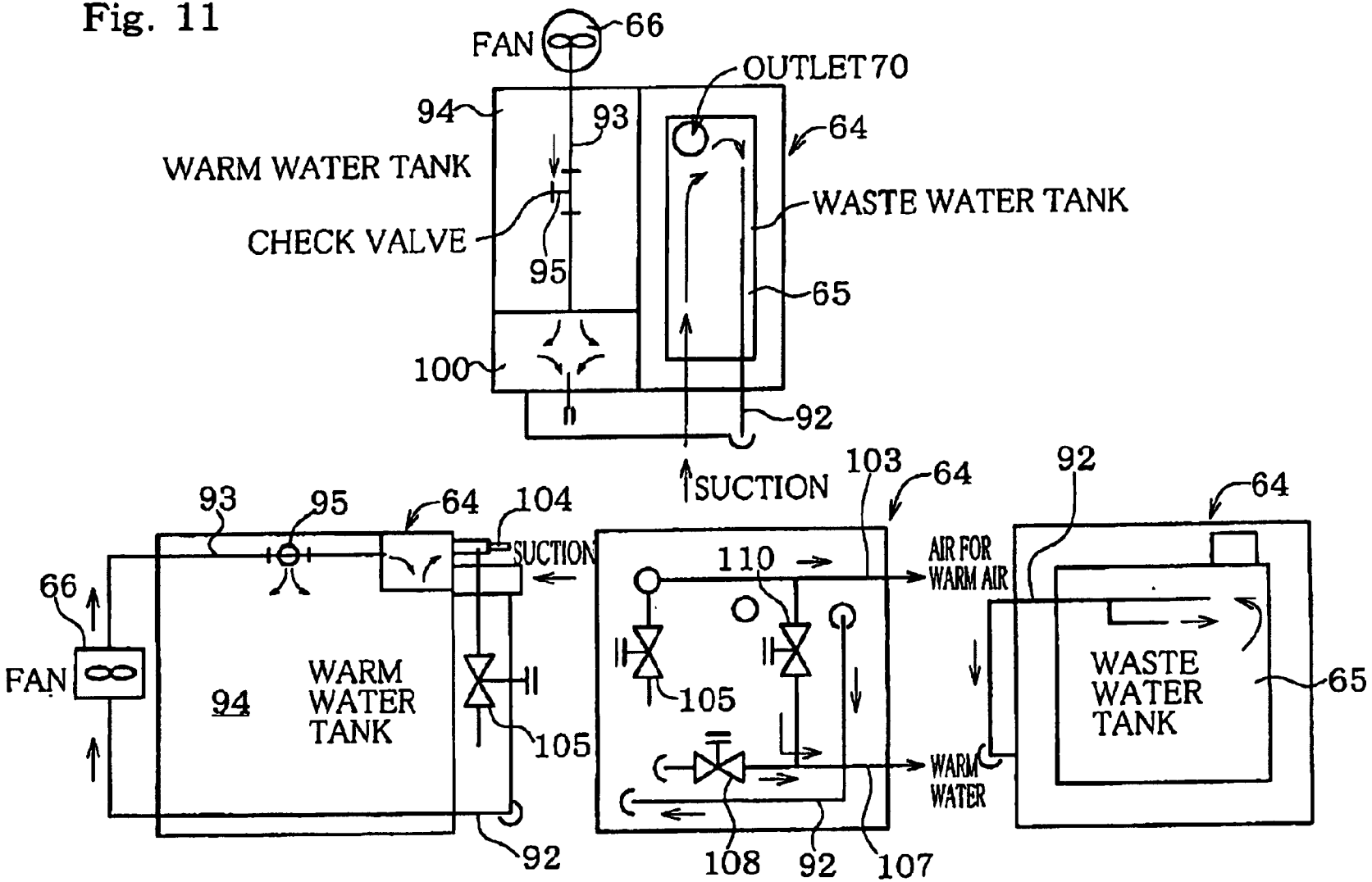
FIG. 11 is a view of a piping system as described to correspond to the plane and three lateral sides of the accessory unit.

As illustrated in FIGS. 10 and 11, air that is sucked from the waste water tank 65 is sucked by the fan motor 66 through a conduit 92 (which is provided either within or outside of the housing 67 of the accessory unit 64, and the same applies to any other conduits mentioned hereafter) and is further sent from the fan motor 66 to a warm water tank 94 side upon passing through a conduit 93. The warm water tank 94 adjoins the waste water tank 65 and is provided either integrally with the housing 67 of the accessory unit or to be detachable and a specified amount of water may be supplied into the warm water tank 94 by detaching a lid 96 (reference should be made to FIG. 8) of a water supply inlet formed on an upper portion. A heater 97 is provided on a bottom portion of the warm water tank 94 for heating the water to a preliminarily determined temperature to obtain warm water and to stock the warm water.

The conduit 93 as illustrated in FIG. 10, is arranged such that it passes through the warm water tank 94 and that air is supplied through the conduit 93 to the warm water tank 94 through a check valve 95 provided in the warm water tank 94 to pressurize the liquid surface of the warm water tank 94. However, it should be noted that no warm water of the warm water tank 94 will enter the conduit 93 through the action of the check valve 95. A notification means (means for urging supply of water) 94*a* for informing that the amount of warm water within the warm water tank 94 has become less than a specified amount is provided as an alarming device utilizing sounds of a buzzer or light of a lamp or the like. A liquid level indicator for indicating the level of currently remaining water within the warm water tank 94 or, alternatively, a water supply gauge 91 (FIG. 8) for indicating an amount of residue upon illuminating a part corresponding to a liquid level from among a plurality of lamps is provided.

The conduit 93 that has passed through the warm water tank 94 next reaches a deodorizing chamber 100 where odor is adsorbed such that the rest of air is sent out from the deodorizing chamber 100. The deodorizing chamber 100 is arranged in that a deodorizing liquid or similar is impregnated into a porous member such as a sponge-like member such that when air including some odor passes through, the odor is adsorbed or neutralized by the porous member and the deodorizing liquid for reducing the odor. An openable/closable lid 106 is provided at the deodorizing chamber 100 (FIG. 8) such that the deodorizing liquid may be replenished therefrom.

The conduit 93 as illustrated in FIGS. 10 and 11 for introducing air (pressurized air) that has passed through the deodorizing chamber 100 is bifurcated into three directions in a conceptual manner to be divided to conduit 101, 102, and 103. The conduit 101 is provided with a flow rate adjusting valve 104 which takes the form of a specified throttle (choke or orifice) upon variably throttling, and a part of pressurized air is allowed to be leaked by a specified amount to the exterior at an end portion of the conduit 101 or the conduit 93. The suction force of waste water based on the actuation of the fan motor 66 may be adjusted through this amount of leakage (amount of discharge), and the more the amount of air discharged from the flow rate adjusting valve 104 is increased, the more the suction force with respect to waste water may be increased.

The conduit 102 that is provided in parallel with the flow rate adjusting valve 104 is provided with a solenoid-type opening/closing valve 105 (hereinafter simply referred to as "solenoid valve") and by exhausting air that is send out from the fan motor 66 upon fully opening the solenoid valve 105, it is possible to achieve maximum suction force. However, performing exhaustion upon continuously opening the solenoid valve 105 may lead to noise in peripheries of the care bed or to smelling of odor, so that it is generally the case that only a part of air is exhausted by a specified amount through the flow rate adjusting valve 104.

A conduit 107 for sending out warm water is formed from the above-described warm water tank 94 (and preferably from a bottom portion of the tank) separate from the conduit 93 for sending out air, wherein the warm water hose 43 is connected to the conduit 107. The conduit 107 is provided with a solenoid-type opening/closing valve (solenoid valve) 108, wherein no warm water is supplied from the warm water tank 94 when the solenoid valve 108 is closed while warm water is supplied to the bedpan 10 upon passing through the conduit 107 and the warm water hose 43 upon opening the same. The driving force (pressurizing force) for supplying warm water is achieved by a part of pressurizing air that is sent out from the fan motor 66 pressing the liquid surface of the warm water tank 94.

The conduit 103 that has bifurcated from the above-described conduit 93 upon passing through the deodorizing chamber 100 is connected to the above-described air hose 44. Pressurized air that is sent out from the fan motor 66 is again sent out to the bedpan 10 through the air hose 44 and is warmed by the heater within the bedpan 10 to become warm air to thus be sent out from the warm air supplying outlet 40. As explained above, air passing from the fan motor 66 through the warm water tank 94 and the deodorizing chamber 100 by the conduit 93 is made to flow through the conduit 103 that is in parallel with the above-described air adjusting valve 104 and the solenoid valve 105, is bifurcated by a conduit 109 in front of the air hose 44 to be connected to the conduit 107 and is further connected to the warm water hose 43 upon passing through the conduit 107.

The conduit 109 for connection is provided with a solenoid-type opening/closing valve (solenoid valve) 110, wherein pressurized air that is sent out from the fan motor 66 flows to the air hose 44 when the opening/closing valve 110 is in a closed condition whereas the pressurized air is made to flow to the warm water hose 43 upon opening of the opening/closing valve 110 for pressurizing the warm water within the hose 43 and pressing the same out for discharge from the warm water discharge outlet 39 of the bedpan 10. In other words, while supply of warm water is normally introduced from the warm water tank 94 to the bedpan 10 upon passing through the conduit 107 and the warm water hose 43, the solenoid valve 110 is opened at the stage cleaning of the pubic region of the care-receiving person is finished by using the warm water so that pressurized air is introduced from the conduit 103 through the conduit 109 and the solenoid valve 110 to the warm water hose 43 such that warm water remaining within the warm water hose 43 is pushed out.

The thus arranged accessory unit 64 is provided with the above-explained fan motor 66, and a control unit 111 for actuating the solenoid valves 105, 108, and 110 (FIG. 1), and a remote controller unit 113 is provided as an operating means for the control unit 111. The remote controller unit 113 is provided with buttons (switches) for manually (through manual operations) instructing start or stop of the fan motor 66, supply of warm water, blow out of warm air etc. and further includes an operating unit such as buttons for selecting either care bedpan system is to be actuated in an automatic mode or in a manual mode for using the same through manual operation based on operations of the remote controller. In case the automatic mode is selected, suction, cleaning and drying of the bedpan or suction are fully automatically performed through a sequence circuit or sequence software provided in the control unit 111 of the accessory unit 64.

Actions performed through fully automatic sequence control will now be explained. Here, it is assumed that excretion is performed with the care-receiving person lying on a specified bed. First, a care-giving person moves the bedpan 10 to lift the same onto the bed such that the opening 31 of the bedpan 10 is substantially adhered in a close manner to the pubic region of the care-receiving person. It should be noted that the angle of the lid member 33 of the opening 31 of the bedpan 10 is suitably adjusted prior to that (reference should be made to FIG. 4) for making the entire opening of the bedpan 10 favorably put against the pubic region through the artificial skin 34 and 35 with regard to differences in a body shape and sex of the care-receiving person and further to hide the pubic region through the lid member 33.

Completion of urination or excretion is detected by the sensor 11 or 12 (FIG. 5). The fan motor 66 is consequently actuated so that suction force is applied to the bedpan 10 through the suction hose 42 while also acting pressurizing force of air onto the warm water tank 94 and opening the solenoid valve 108 whereupon warm water for washing is supplied into the bedpan 10 for sucking the excrements to the waste water tank 65 through the suction hose 42. At this time, the solenoid valve 105 is opened to set the suction force to a maximum level.

After elapse of a specified period of time, it is assumed that the excrements have been sucked whereupon the solenoid valve 105 is closed and warm water is jetted from the warm water supply outlet 39 of the bedpan 10 for cleaning the pubic region of the care-receiving person after excretion by using the warm water (in this embodiments, the warm water is jetted from the outlet 39 concurrently with the warm water being jetted from the warm water jetting outlets 41*a*, 41*b*). After jetting warm water for a specified period of time, the solenoid valve 110 (reference should be made to FIG. 10 and FIG. 11) is opened for pushing warm water remaining in the warm water hose 43 out through pressurized air that is sent out from the fan motor 66. Warm water remaining in the warm water hose 43 will be cool such that cold water will be jetted at the next occasion of cleaning one's pubic region which is undesirable, and it is for preventing such conditions that the interior of the warm water hose 43 is emptied after supply of warm water.

The solenoid valve 110 is closed thereafter so that the pressurized air that is sent out from the fan motor 66 is sent to the bedpan 10 by passing through the conduits 93, 103, and the air hose 44. The pressurized air is heated by the heater 45 in the bedpan 10 (reference should be made to FIG. 4) to become warm air whereupon this warm air is blown out from the warm air blowing outlet 40 (reference should be made to FIG. 3) for drying the pubic region of the care-receiving person after cleaning with the warm water. After blowing of warm air for a specified period of time, the fan motor 66 is terminated, whereupon the series of operations for sucking excrements and blowing out of warm water and warm air is completed. Then, the bedpan 10 is removed from the pubic region and moved out of the bed.

It should be noted that in case manual operations are to be performed through the remote controller unit 113 instead of choosing the automatic mode, suctioning by the bedpan 10, time for cleaning through warm water and drying through warm air can be suitably set at timings as instructed by the user upon operating the buttons.

What is claimed is:

1. A care bedpan which is movable and portable comprising an opening that is pressed against or disposed to oppose a pubic region of a care-receiving person for receiving excrements, and an inner side of said opening being provided with a front-sided bottom portion that extends in a substantially horizontal manner rearward from a front end and that is surrounded by a low bottom wall portion, and a rear-sided rising wall portion that rises substantially upward from rear-side of said front-sided bottom portion and at least both sides of which are surrounded by a low side wall portion, wherein a rearward facing washing water outlet for discharging washing water for processing excrements in a rearward direction is formed at a bottom wall portion at a tip end of said front-sided bottom portion whereas a suction inlet for sucking said excrements and washing water is formed at a lower end portion of a front-sided rising wall portion rearward of said washing water outlet, wherein a cleaning water outlet for jetting cleaning water for cleaning one's pubic region in a frontward direction is formed further upward of said suction inlet of said rear-sided rising wall portion and the cleaning water is sucked by said suction inlet, and wherein the front-sided bottom portion is provided, in addition to said rearward facing washing water outlet formed at the front end, with washing water outlets for centering, which are located further rearward of said washing water outlet, for discharging washing water for processing excrements from both wall portions of the front-sided bottom portion towards the center such that excrements are guided to said suction inlet through cooperative actions of washing water, which is discharged rearwards from the rearward facing washing water outlet at the front end, and washing water, which is discharged from the washing water outlet for centering on both sides towards the center.

2. A care bedpan system comprising a care bedpan including a washing water outlet as well as a suction inlet for sucking excrements together with the washing water, and an excrement collecting device for sucking and collecting excrements from the bedpan, wherein said excrement collecting device includes a suction hose for sucking excrements that is connected to said bedpan, a suction device that is connected to the hose for setting the interior of the hose to negative pressure so as to suck and transfer said excrements through the hose, and an excrement tank for collecting excrements that are transferred through the hose, and wherein a circulating conduit is formed for accumulating, at the time of collecting the said sucked excrements into the collecting device together with air, the excrements in the excrement tank while only air is sucked to a sucking driving unit through a suction conduit and wherein pressurized air that has passed through the suction driving unit and that has become positive pressure on the downstream side is circulated to the bedpan side as air for sending out washing water and/or cleaning water to the bedpan, while a releasing unit for releasing a part of the pressurized air is also provided.

3. A care bedpan system comprising a care bedpan including a washing water outlet as well as a suction inlet for sucking excrements together with the washing water, and an excrement colleting device for sucking and collecting excrements from the bedpan, wherein said excrement collecting device includes a suction hose for sucking excrements that is connected to said bedpan, a suction device that is connected to the hose for setting the interior of the hose to negative pressure so as to suck and transfer said excrements through the hose, and an excrement tank for collecting excrements that are transferred through the hose, wherein a circulating conduit is formed for accumulating, at the time of collecting the said sucked excrements into the collecting device together with air, the excrements in the excrement tank while only air is sucked to a sucking driving unit through a suction conduit, wherein pressurized air that has passed through the suction driving unit and that has become positive pressure on the downstream side is circulated to the bedpan side as air for sending out washing water and/or cleaning water to the bedpan, and wherein the said circulating conduit is provided with the discharge outlet for discharging a part of the circulating air to the exterior and adjusting valve for adjusting the discharge amount of air through the discharge outlet.

4. A care bedpan system comprising a care bedpan including a washing water outlet as well as a suction inlet for sucking excrements together with the washing water, and an excrement collecting device for sucking and collecting excrements from the bedpan, wherein said excrement collecting device includes a suction hose for sucking excrements that is connected to said bedpan, a suction device that is connected to the hose for setting the interior of the hose to negative pressure so as to suck and transfer said excrements through the hose, and an excrement tank for collecting excrements that are transferred through the hose, and the care bedpan system composing:

a warm water tank for storing the warm water for cleaning, a cleaning hose connecting the said warm water tank with the said bedpan for supplying warm water to the warm water jetting outlet which serves as said cleaning water outlet so as to clean one's pubic region after excretion, an excrement sucking hose connecting the said bedpan with the excrement tank for sucking and collecting excrements and waste water after cleaning from the bedpan, a fan motor for driving a fan that acts sucking negative pressure on the said excrement sucking hose and for circulating air within the said circulating conduit, and a warm water pressurizing conduit for introducing a part of air circulating with the said circulating conduit to the said warm water tank side and pressurizing the said warm water of the warm water tank so as to supply the same to the warm water jetting outlet of the said bedpan.

5. A care bedpan system comprising a care bedpan including a washing water outlet as well as a suction inlet for sucking excrements together with the washing water, and an excrement collecting device for sucking and collecting excrements from the bedpan, wherein said excrement collecting device includes a suction hose for sucking excrements that is connected to said bedpan, a suction device that is connected to the hose for setting the interior of the hose to negative pressure so as to suck and transfer said excrements through the hose, and an excrement tank for collecting excrements that are transferred through the hose, and the care bedpan system composing:

a warm water tank for storing the said warm water, a cleaning hose connecting the warm water tank with the said bedpan for supplying warm water to the said warm water jetting outlet which serves as said cleaning water outlet so as to clean one's pubic region after excretion, an air hose drying connected to the air-blowing outlet which serves as an air outlet of the said bedpan for supplying air for making warm air for drying one's pubic region after cleaning blown out through the air-blowing outlet of the bedpan, an excrement sucking hose connecting the said bedpan with the said excrement tank for sucking and collecting excrements and waste water after cleaning from the bedpan, a fan motor for driving a fan that acts sucking negative pressure on the said excrement sucking hose and for circulating air within the said circulating conduit, a warm water pressurizing conduit for introducing a part of air circulating within the said circulating conduit to the said warm water tank side and pressurizing the warm water of the warm water tank so as to supply the same to the warm water jetting outlet of the said bedpan, and an air supplying conduit for introducing a part of air circuiting through the said circulating conduit to the said air hose for drying, and supplying the introduced air to the said bedpan through the air hose for drying.

* * * * *